United States Patent [19]

Popov

[11] 4,014,961

[45] Mar. 29, 1977

[54] EJECTOR MIXER FOR GASES AND/OR LIQUIDS

[76] Inventor: Vitaly Fedorovich Popov, ulitsa Gogolya, 4, kv.13, Severodonetsk, Voroshilovgradkoi oblati, U.S.S.R.

[22] Filed: Apr. 21, 1975

[21] Appl. No.: 570,224

Related U.S. Application Data

[63] Continuation of Ser. No. 354,004, April 24, 1973, abandoned.

[52] U.S. Cl. ..... 261/76; 239/404; 239/432; 261/79 A; 261/DIG. 75; 417/177

[51] Int. Cl.[2] ..... B05B 7/10

[58] Field of Search ..... 261/DIG. 48, 76, 78 A, 261/79 A, DIG. 75, DIG. 54; 417/176, 177; 239/102, 400, 404, 427, 430, 432

[56] References Cited

UNITED STATES PATENTS

| | | | |
|---|---|---|---|
| 1,315,931 | 9/1919 | Poppink | 417/177 |
| 1,567,482 | 12/1925 | Anthony | 239/404 |
| 1,934,837 | 11/1933 | Zulver | 239/400 |
| 3,157,359 | 11/1964 | Fortman | 239/102 |
| 3,326,467 | 6/1967 | Fortman | 239/102 |
| 3,741,484 | 6/1973 | Cresswell | 239/102 |
| 3,829,015 | 8/1974 | Monro | 239/102 |
| 3,834,364 | 9/1974 | Bartholomew | 261/DIG. 48 |
| 3,912,164 | 10/1975 | Lefebvre et al. | 239/5 |

FOREIGN PATENTS OR APPLICATIONS

| | | | |
|---|---|---|---|
| 575,697 | 1924 | France | 230/103 |
| 330,886 | 1972 | U.S.S.R. | 239/102 |

*Primary Examiner*—Tim R. Miles
*Assistant Examiner*—Gregory N. Clements

[57] ABSTRACT

An ejector mixer for gases and/or liquids comprising three coaxial nozzles in communication with a mixing chamber that merges into a diffuser. One component to be mixed is fed into the middle annular nozzle, while the other component is supplied via the outer and the inner annular nozzle, so that the stream or the first component, upon entry into the annular mixing chamber, will be confined by the two streams of the second component.

4 Claims, 5 Drawing Figures

EJECTOR MIXER FOR GASES AND/OR LIQUIDS

This application is a continuation application of Ser. No. 354,004; filed Apr. 24, 1973 now abandoned.

This invention relates to ejector-type devices for mixing and subsequent pumping or conveying of gaseous and/or liquid materials.

The present invention may find application, for example, for preparing a methane-oxygen mixture at a temperature of 800° to 900° C to be used for acetylene production, for preparing and feeding gaseous mixtures into gas generators or converters, and also in diverse technological processes, which call for the employment of high-capacity stream ejectors or ejector-type compressors.

An ejector mixer is known which comprises two coaxially disposed annular nozzles in communication with an annular mixing chamber, said mixing chamber merging into a diffuser.

In said known ejector mixer, two components are fed into the mixing chamber separately via the two annular nozzles, so that at the nozzle exit side the resulting annular streams of the components contact each other and each of the two streams contacts the mixing chamber wall. From the mixing chamber, the mixture thus obtained is directed, via the diffuser, for subsequent utilization. The diffuser function is to increase the static pressure of the prepared mixture as a result of diminishing the velocity of mixture flow and also to distribute the mixture in question over a large surface area at the site of mixture utilization.

The ejector mixer with annular nozzles may be designed to meet practically any throughput capacity requirement, but is disadvantageous in that its efficiency is low because the area of contact between the phases of the components being mixed in small and the hydraulic pressure losses in the mixing chamber and diffuser are high.

The known annular nozzle-type ejector mixers are further disadvantageous in that they are unsuited for use in conjunction with highly reactive components that contain oxidizing agents, since in said mixers both components contact the mixing chamber walls which, under high temperatures, catalyze the reactions of explosion or combustion.

It is an object of the present invention to provide an ejector mixer for gases and/or liquids which makes it possible to effect the mixing of exceptionally reactive components at high temperatures and to attain a higher efficiency of the mixing process as compared to the known ejector mixer with annular nozzles.

This object is attained by an ejector mixer for gases and/or liquids having coaxially disposed annular nozzles in communication with an annular mixing chamber which merges into a diffuser wherein, according to the invention, provision is made for three annular nozzles disposed coaxially and for means of feeding into the middle annular nozzle one component and for feeding into the inner and the outer nozzles the other component, thereby placing the annular stream of the first component, on the annular mixing chamber inlet side between the two annular streams of the second component.

The aforesaid design feature of the present ejector mixer results in a more than two-fold increase of the contact area of component phases entering the mixing chamber and in insulating a more reactive component, e.g. oxidant, from the mixing chamber walls by feeding said reactive component through the middle annular nozzle.

To minimize the mixing time and decrease the mixing chamber length, it is expedient to provide toroidal cavities in the inner walls of the middle annular nozzle throat, said toroidal cavities functioning as resonators which excite acoustic oscillation (high-frequency pulses) in the stream that passes through the middle annular nozzle.

The pulsatory feed of a component into the mixing chamber increases markedly the degree of turbulence, thereby enhancing significantly the efficiency of the present ejector mixer, an associated effect being the feasibility of decreasing the length of the mixing chamber to such an extent that the mixing chamber proper ceases practically to exist and can be made integral with the diffuser.

Uniform distribution and feed of the second component through the inner and the outer nozzles, as well as additional turbulization of the stream can be attained by providing in the inner and the outer annular nozzles appropriate guide vanes for swirling in the opposite directions the jets issuing from said nozzles.

Where use is made of a wide-angle diffuser, it is good practice to mount at the diffuser exit a distributing grid made of a plurality of concentric rings, thereby making it possible to obtain a uniform velocity field for the mixture leaving the ejector mixer.

The present invention is illustrated hereinbelow by the description of an exemplary embodiment thereof with reference to the accompanying drawings, wherein.

Figure 1:
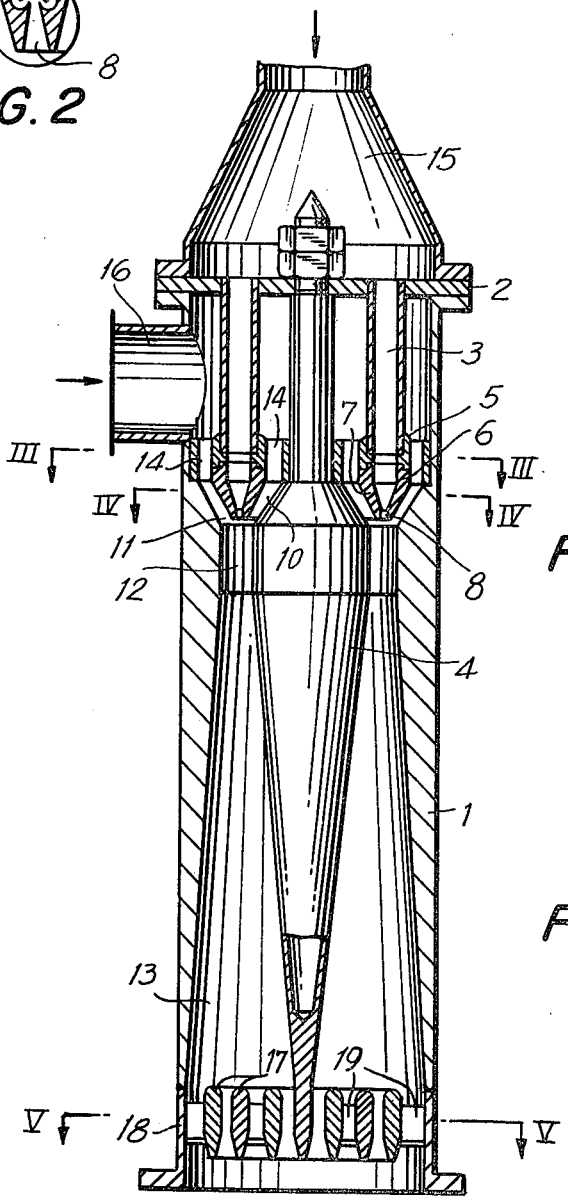
FIG. 1 is a longitudinal section through the ejector mixer, according to the present invention.

The ejector mixer for gases and/or liquids comprises a casing 1 (FIG. 1), in which there is mounted a tube sheet 2 with distributing tubes 3 affixed thereto in annular arrangement around a center body 4. As can be seen in FIG. 1, the bottom ends of the distributing tubes 3 are connected by an annular grid 5 having two shaped rings 6 and 7 mounted therein so as to form a middle annular nozzle 8 of the ejector mixer.

Figure 2:
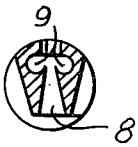
FIG. 2 is a longitudinal sectional view on enlarged scales of the middle annular nozzle having toroidal cavities (resonators), according to the invention.

In a modification of the ejector mixer, the inner walls of the middle annular nozzle 8 are furnished, in the throat of said nozzle, with toroidal cavities (resonators) 9 shown in FIG. 2.

The inner walls of the casing 1 (FIG. 1), the lateral surface of the center body 4 and the external surfaces of the shaped rings 6, 7, in combination, form all other elements of the ejector mixer, viz., the inner annular nozzle 10, the outer annular nozzle 11, and the annular mixing chamber 12, which merges into an annular diffuser 13.

The inner annular nozzle 10 and outer annular nozzle 11 are furnished at the upper portions thereof with guide vanes 14, which impart a swirling movement in opposite directions to the jets issuing from said nozzles.

Figure 3:
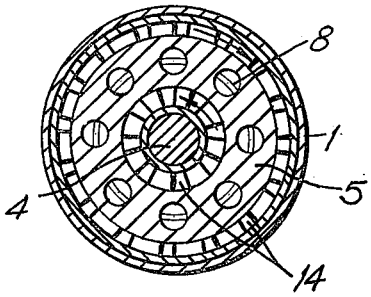
FIG. 3 is a sectional view through the ejector mixer taken along line III—III in FIG. 1.

The rotation directions imparted to the jets by the vanes 14 are indicated by arrows in FIG. 3.

Figure 4:
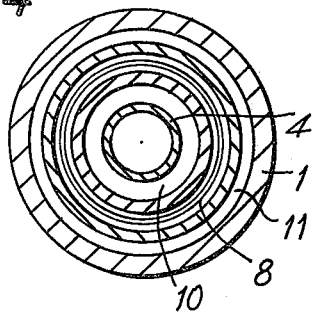
FIG. 4 is a sectional view through the ejector mixer taken along line IV—IV in FIG. 1.

FIG. 4 shows the coaxial arrangement of the annular nozzles viz. the middle nozzle 8, the inner annular nozzle 10 and the outer nozzle 11, whereby the annular stream of the component issuing from the middle annular nozzle 8 is enveloped both inside and outside by the two annular streams of the second component that issue from the inner annular nozzle 10 and the outer annular nozzle 11.

In the ejector mixer (FIG. 1) provision is made for a means for feeding the first component into the middle annular nozzle 8, said means comprising a tapered connector 15, the distributing tubes 3 and the annular grid, as well as for a second means for feeding the second component into the inner annular nozzle 10 and the outer annular nozzle 11, said second means comprising a connector 16 and the intertubular space.

Figure 5:
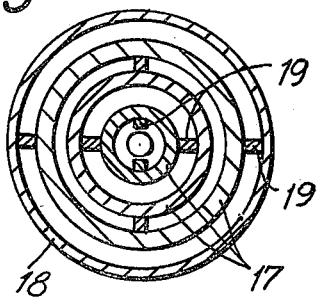
FIG. 5 is a sectional view through the ejector mixer taken along lines V—V in FIG. 1.

A distributing grid built up by a plurality of concentrically disposed rings 17 is mounted at the exit side of the annular diffuser 17, said rings 17 being secured inside a cylindrical shell 18 by means of connection strips 19 as shown in FIG. 5.

The ejector mixer operates in the following manner.

A high-pressure stream of the first component is directed via the connector 15, the distributing tubes 3 and the middle annular nozzle 8 and enters, in the form of an annular jet, the annular mixing chamber 12.

Also introduced in the mixing chamber 12, via the connector 16, the intertubular space and the vanes 14, and the inner and outer annular nozzles 10 and 11 and swirling annular high-pressure streams of the second component to be mixed, said second component streams enveloping said annular stream of the first component.

If the middle annular nozzle 8 is furnished with toroidal cavities (resonators) 9 (FIG. 2), the high-pressure stream, on contact with the sharp edge of a resonator 9, excites therein acoustic oscillations, said oscillations being amplified by a second resonator 9 opposite in phase to the first resonator 9, whereupon the thus-produced pulses propagate into the mixing chamber 12 (FIG. 1) and the diffuser 13.

The velocity fields and the concentrations of the components being mixed undergo equalization in the mixing chamber 12 and the diffuser 13.

The diffuser 13 and the concentric rings 17 of the distributing grid are instrumental in spreading uniformly the resulting two component mixture over a large surface at the site of mixture utilization and in attaining a homogeneous velocity field within the stream.

The ejector mixer, according to the present invention, in which the stream of one component, at the inlet side of the mixing chamber 12, is confined within the two streams of the second component and mixing occurs in a very short period of time, is eminently suited for such applications as, for example, methane-oxygen mixture preparation at a temperature of 800° to 900° C, said mixture being intended for acetylene production by the partial combustion of methane in oxygen.

The process of mixing is effected by feeding oxygen into the ejector mixer of the invention via the middle annular nozzle 8, while methane is being supplied through the inner annular nozzle 10 and the outer annular nozzle 11.

Owing to the insulation of the oxygen annular system entering the annular mixing chamber 12 by two methane streams and to the provision of a large contact area between the components to be mixed, it is practicable to effect the mixing of said components at a temperature of from 800° to 900° C within a period of time essentially shorter than the induction period of methane-oxygen mixture self-ignition.

The aforesaid conditions of carrying out the process make for increasing the concentration of the target compound (acetylene) in the pyrolysis products equals up to 10 vol.% as compared to the acetylene content of 8–8.5 vol.% obtained by heating the mixture components to a temperature of 600° to 650° C and carrying out the process of incomplete methane combustion in reactors involving the use of conventional mixing means.

Apart from raising the concentration of acetylene, the employment of the present ejector mixer in conjunction with the acetylene production process provides the possibility of designing a reactor noted for its enhanced throughput capacity and, hence, of reducing the cost price of acetylene manufactured by the partial combustion of hydrocarbons of oxygen.

We claim:

1. An ejector mixer for fluids comprising a casing, a tube sheet mounted in said casing and dividing the same into first and second spaces, a plurality of vertical distributing tubes having upper ends mounted in said tube sheet around the circumference of a circle, said upper ends of the tubes communicating with said first space, a first inlet for a first fluid communicating with said first spaces to feed said fluid to said tubes, a second inlet for a second fluid communicating with said second space, a pair of coaxial annular rings in said casing defining an annular nozzle, said distributing tubes having lower ends, an annular grid coupled to said lower ends of the distributing tubes and to said annular rings to provide communication between said lower ends of the tubes and said annular nozzle such that the latter receives the first fluid from the tubes, means in said casing forming inner and outer nozzles coaxially arranged with respect to the first said annular nozzle which forms a middle nozzle between said inner and outer nozzles, said inner and outer nozzles being in communication with said second space to receive the second fluid therefrom, an annular mixing chamber in said casing facing said nozzles for receiving the streams of fluids discharged from the three nozzles for mixing of the streams, the stream of the first fluid from the middle nozzle being confined between the streams of the second fluid from the inner and outer nozzles, guide vanes mounted around said annular grid at the inner and outer peripheries thereof for swirling the streams discharged from the first and second nozzles in opposite directions to promote mixing with the stream discharged from the middle nozzle, and a diffuser in said casing coupled to the mixing chamber for receiving the mixed streams therefrom, said diffuser having a discharge end for discharging the mixed streams from the casing.

2. An ejector mixer as claimed in claim 1 wherein said middle nozzle includes resonator means constituted by two toroidal cavities symmetrically disposed therein, said middle nozzle having a throat with said toroidal cavities disposed thereat for exciting acoustic oscillations in the stream discharged from the middle nozzles.

3. An ejector mixer as claimed in claim 2 wherein said toroidal cavities are provided in said annular rings in the inner walls thereof.

4. An ejector mixer as claimed in claim 1 comprising a distributing grid in said casing at said discharge end of the diffuser, said distributing grid including a plurality of concentric rings.

* * * * *